US006917359B1

(12) United States Patent
Nanba et al.

(10) Patent No.: US 6,917,359 B1
(45) Date of Patent: Jul. 12, 2005

(54) INFORMATION DISPLAY DEVICE AND INFORMATION DISPLAY METHOD

(75) Inventors: Katsuyuki Nanba, Sakai (JP); Isao Hayami, Ashiya (JP); Takashi Kondo, Sakai (JP); Sadafusa Tsuji, Tondabayashi (JP); Hideo Hotomi, Nishinomiya (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/538,339

(22) Filed: Mar. 29, 2000

(30) Foreign Application Priority Data

Mar. 31, 1999 (JP) ..... 11-093008

(51) Int. Cl.[7] ..... G09G 5/22
(52) U.S. Cl. ..... 345/211; 345/212
(58) Field of Search ..... 345/211, 212, 345/156, 501, 530, 204, 7, 84, 87–104, 901, 133, 115, 126, 213, 214

(56) References Cited

U.S. PATENT DOCUMENTS

| | | | | | |
|---|---|---|---|---|---|
| 5,239,665 | A | | 8/1993 | Tsuchiya | 395/800 |
| 5,467,102 | A | * | 11/1995 | Kuno et al. | 345/1 |
| 5,777,611 | A | * | 7/1998 | Song | 345/212 |
| 5,841,431 | A | * | 11/1998 | Simmers | 345/211 |
| 6,005,559 | A | * | 12/1999 | Miyamoto | 345/212 |
| 6,266,113 | B1 | * | 7/2001 | Yamazaki et al. | 349/115 |

FOREIGN PATENT DOCUMENTS

| | | | | |
|---|---|---|---|---|
| JP | 403103890 A | * | 4/1991 | G09G/5/00 |
| JP | 403103891 A | * | 4/1991 | G09G/5/00 |
| JP | 405249934 A | * | 9/1993 | G09G/5/00 |
| JP | 09265470 | * | 7/1997 | G06F/17/30 |
| JP | 09-265470 A | | 10/1997 | |
| WO | 8701481 A1 | * | 3/1987 | G06F/3/06 |
| WO | 8809985 A1 | * | 12/1988 | G06G/3/00 |

OTHER PUBLICATIONS

EDN Magazine, Design Ideas,http://www.reed–electronics.com/ednmag/archives/1997/121897/26di_04.htm#Figure%201;Dec. 18, 1997, pp. 1–4.*

Publication # 09265470 of Japanese Patent Office (Patent Abstracts of Japan): Electronic Book Device, filed Mar. 28, 1996, Inventor: Yamazaki Koichi.*

* cited by examiner

*Primary Examiner*—Michael Razavi
*Assistant Examiner*—Javid Amini
(74) *Attorney, Agent, or Firm*—Sidley Austin Brown & Wood LLP

(57) ABSTRACT

An information display device which is structured as an electronic book with liquid crystal displays which display information stored in a storage medium. The information display device further has a first driving section which drives the liquid crystal displays and a second driving section which drives the recording medium, and while the displays are reset, the second driving section is inhibited from driving the storage medium. Also, the information display device has a speaker, and when a mode to display information on the liquid crystal displays at a high speed is selected, the speaker is inhibited from reproducing sound.

20 Claims, 9 Drawing Sheets

INFORMATION DISPLAY DEVICE AND INFORMATION DISPLAY METHOD

This application is based on application No. 11-93008 filed in Japan, of which content is hereby incorporated.

BACKGROUND OF THE INVENTION

1. Field of the Invention

The present invention relates to an information display device, and more particularly to an information display device and an information display method for displaying information stored in a storage medium on a display as visible information.

2. Description of Prior Art

Recently, an information display device (an electronic book) which is capable of taking in and ejecting a storage medium, such as a CD-ROM, an MD or the like, stored with digital information of books and reads out a desired piece of information from the storage medium to display the information on a liquid crystal display as visible information is suggested (for example, see Japanese Patent Laid Open Publication No. 9-265470) and is being developed into various types. Such electronic books are generally structured to be mobile and driven by a battery.

Meanwhile, various kinds of liquid crystal are used for displays which display information, and the driving characteristics to drive liquid crystal, such as the driving method, the driving voltage, etc., are different from kind to kind. It is very effective for energy saving of an electronic book to use liquid crystal with a memory effect which does not consume electric power in a state to keep displaying information thereon.

However, liquid crystal with a memory effect generally requires a high voltage for reset to get ready for writing thereon. In a structure using a battery, if another member which requires a high voltage is driven simultaneously with reset of the liquid crystal, a voltage drop may occur, which means instability of operation. Liquid crystal with a memory effect also requires a relatively long time for reset, and therefore, when such liquid crystal is used for an electronic book, it takes a long time for paging. If audio information is reproduced simultaneously with display of information, it takes a longer time for paging. Especially, if it takes a long time to execute a mode to display series of information rapidly, the rapid display mode becomes nonsense.

SUMMARY OF THE INVENTION

An object of the present invention is to provide an information display device and an information display method which are capable of preventing a driving voltage from dropping, which avoids instability of operation.

Another object of the present invention is to provide an information display device and an information display method which never degrade performance in a rapid display mode.

In order to attain the objects, an information display device according to the present invention comprises: a display section which displays information stored in a storage medium as visual information; a first driving section which drives the display section to write information thereon; a second driving section which drives the storage medium to read information from the storage medium; a power source section which supplies electric power to the first and second driving sections; and a control section which inhibits the second driving section from driving the storage medium while the first driving section performs a reset operation of the display section.

In the above information display device, during a reset operation of the display section which requires a high voltage, a drive of the storage medium which also requires a high voltage is inhibited, so that the supply of a high voltage to the display section can be guaranteed. Thereby, instability of operation due to a drop of the driving voltage can be avoided.

Another information display device according to the present invention comprises: a display section which uses liquid crystal with a memory effect and displays information stored in a storage medium; a sound reproducing section which reproduces sound in accordance with the information displayed; a power source section which supplies electric power to the display section and the sound reproducing section; a selecting section which selects a mode to perform writing of information on the display section at a specified speed; and a control section which inhibits the sound reproducing section from reproducing sound when the selecting section selects the mode.

In the above information display device, during execution of the mode to perform writing at a specified a speed (rapid display mode), reproduction of sound which is a relatively heavy load on the power source section is inhibited. Therefore, writing on the display section is never delayed, thereby avoiding trouble of degrading performance in the rapid display mode.

BRIEF DESCRIPTION OF THE DRAWINGS

These and other objects and features of the present invention will be apparent from the following description with reference to the accompanying drawings, in which.

DETAILED DESCRIPTION OF THE PREFERRED EMBODIMENTS

Embodiments of an information display device and an information display method according to the present invention will be described with reference to the accompanying drawings. In the following embodiments, the present invention is mainly applied to an electronic book.

Appearance of Electronic Book

Figure 1:
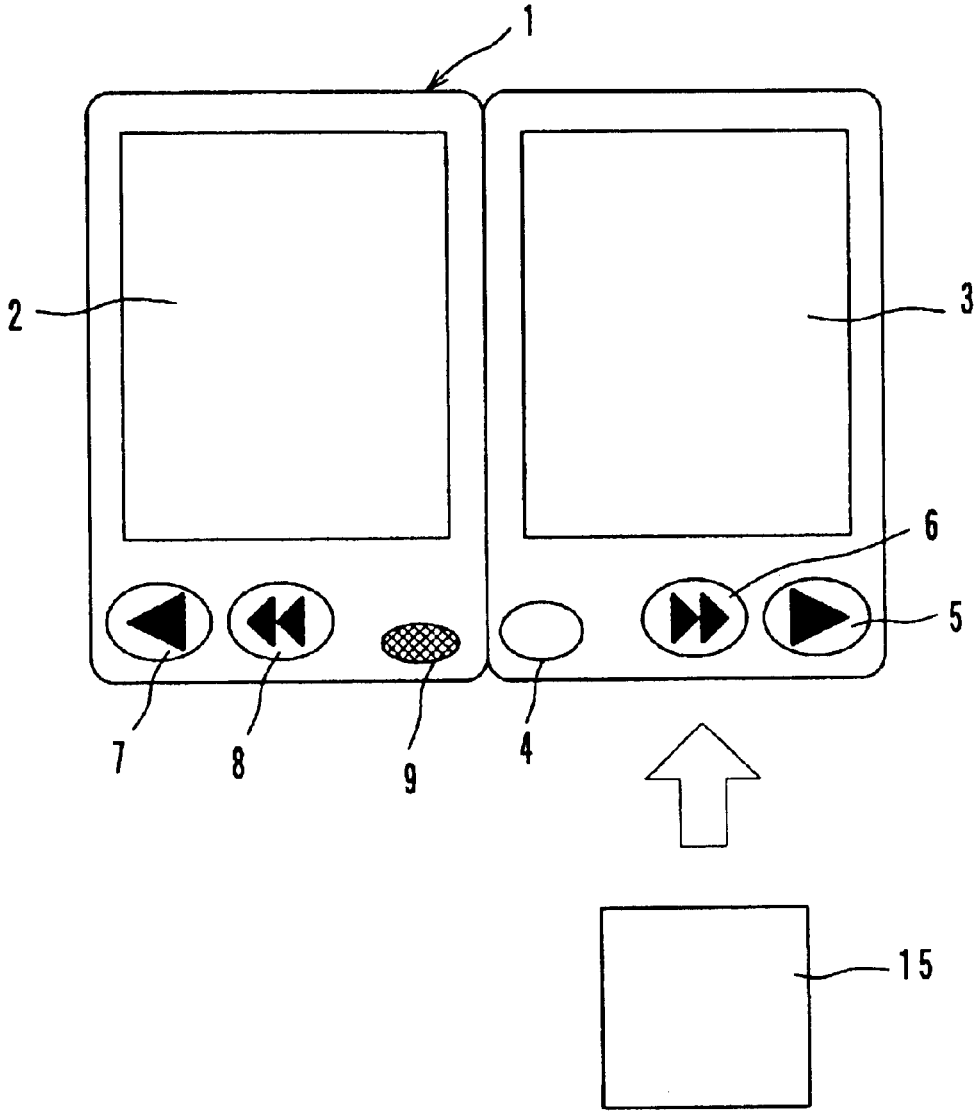
FIG. 1 is a front view of an electronic book which is an embodiment of the present invention.
Figure 2:
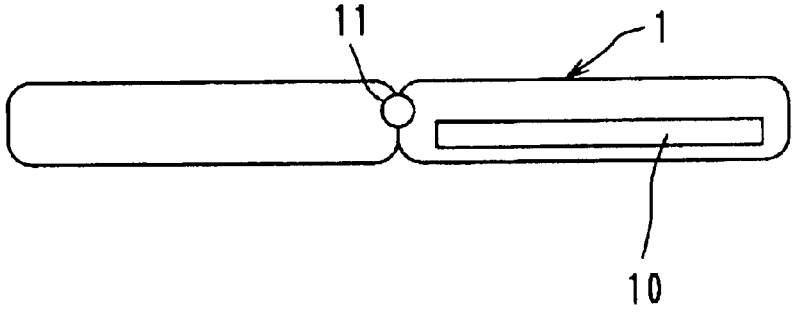
FIG. 2 is a bottom view of the electronic book.

FIGS. 1 and 2 show the appearance of an electronic book 1 which is an embodiment of the present invention. The electronic book 1 is foldable on the center shaft 11, and two screens 2 and 3 of liquid crystal displays are provided on right and left. Various kinds of literal and image information can be displayed on the screens 2 and 3 as are written in books and magazines. The liquid crystal displays have a memory effect and are driven by a matrix method, and the structure and the driving method of the liquid crystal displays will be described in detail later.

Information to be displayed on the screens 2 and 3 and audio information to be outputted from a speaker is stored in a storage medium 15 such as an MD, an FD, a CD, a DVD or the like. A slot 10 for insertion of the storage medium is provided on the bottom side of the electronic book 1.

Under the screen 3, a power switch 4, a page forward switch 5 and a fast forward switch 6 are provided. Under the screen 2, a page backward switch 7, a fast backward switch 8 and a speaker 9 are provided. Every time the page forward switch 5 is pressed once, the next two pages are displayed on the screens 2 and 3. While the fast forward switch 6 is being pressed, the next pages are displayed one after another rapidly in a rapid display mode. When the fast forward switch 6 is released from pressure, the pages on the screens 2 and 3 at that time are displayed in an ordinary display mode. Every time the page backward switch 7 is pressed once, the previous two pages are displayed on the screens 2 and 3. While the fast backward switch 8 is being pressed, the previous pages are displayed backward rapidly in the rapid display mode. When the fast backward switch 8 is released from pressure, the pages on the screens 2 and 3 at that time are displayed in the ordinary display mode.

Control Circuit

Figure 3:
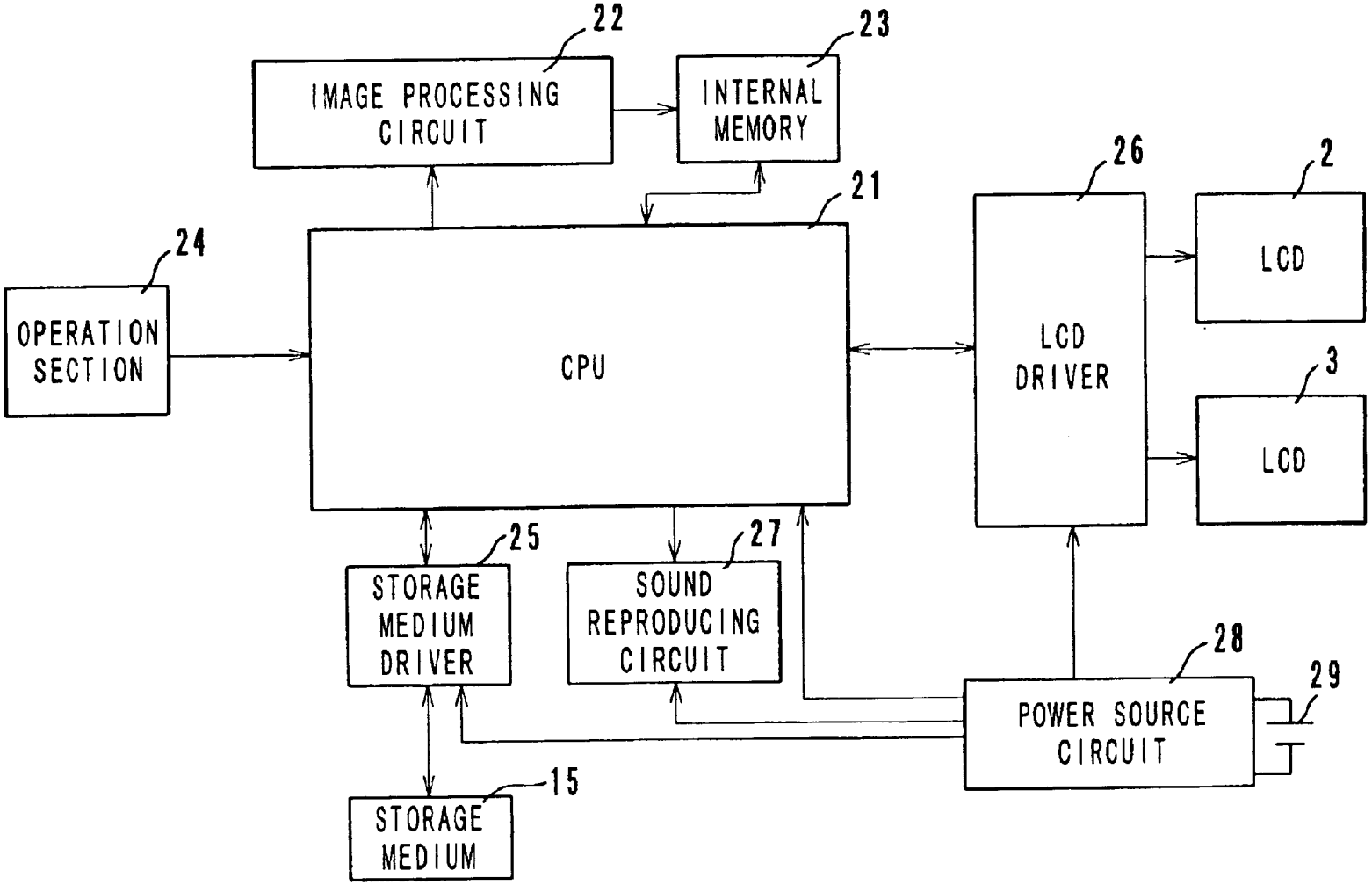
FIG. 3 is a block diagram which shows a control circuit of the electronic book.

FIG. 3 shows a control circuit of the electronic book 1. The main member of this circuit is a CPU 21, and the circuit incorporates an image processing circuit 22, an internal memory 23, an operation section 24 composed of the switches 4 through 8, a storage medium driver 25, an LCD driver 26, a sound reproducing circuit 27 and a power source circuit 28.

The storage medium driver 25 drives the storage medium 15 inserted in the slot 10 so as to read information from the storage medium 15 and to send the information to the CPU 21. The storage medium driver 25 comprises a spindle motor to rotate the storage medium 15, a head driver and a pick-up optical system driver. The image processing circuit 22 processes the information read out by the driver 25 into image data. The image data are stored in the internal memory 23. The LCD driver 26 drives the liquid crystal displays in a matrix driving method. The sound reproducing circuit 27 is to reproduce audio information corresponding to the information displayed on the screens 2 and 3, and the speaker 9 is incorporated in this circuit 27. The power source circuit 28 incorporates a battery 29 as a power source and a booster circuit, and supplies electric power to the CPU 21, the drivers 25, 26 and the sound reproducing circuit 27.

In this embodiment, when the screens 2 and 3 are reset for writing thereon, that is, when the page forward switch 5 or the page backward switch 7 is turned on, the CPU 21 controls the power source circuit 28 not to supply electric power to the storage medium driver 25. When the rapid display mode is commanded, that is, when the fast forward switch 6 or the fast backward switch 8 is turned on, the CPU 21 controls the sound reproducing circuit 27 not to reproduce audio information. Then, when the switch 6 or 8 is turned off, reproduction of audio information is started. A procedure for the control will be described in detail later referring to FIGS. 9 and 10.

Structure of Liquid Crystal Display

Figure 4:
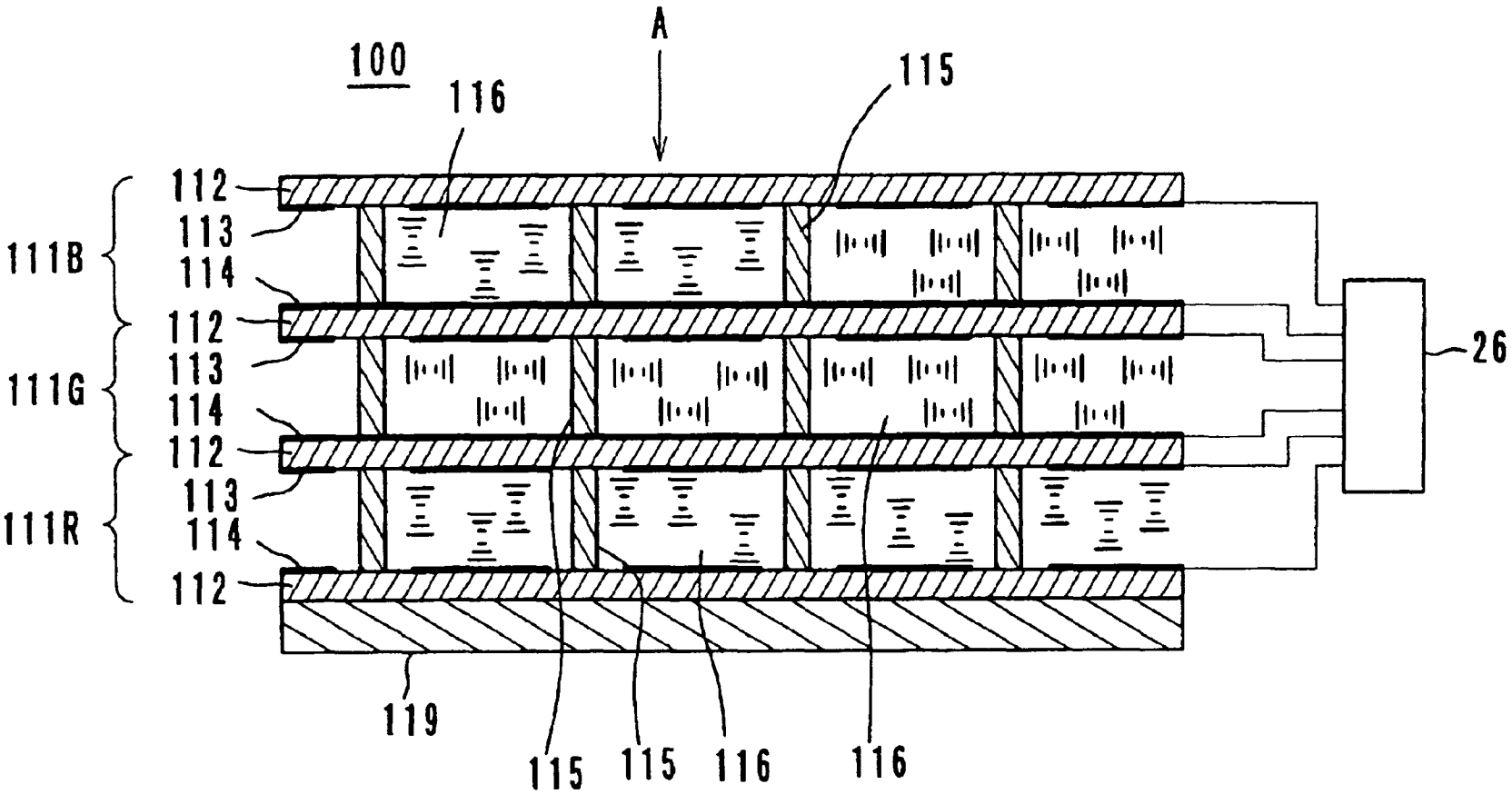
FIG. 4 is a sectional view of an exemplary liquid crystal display to be employed as a display of the electronic book.

FIG. 4 shows a liquid crystal display 100, which is installed behind each of the screens 2 and 3. This liquid crystal display 100 has, on a light absorber 119, a red display layer 111R which makes a display by switching between a red selective reflection state and a transparent state is provided. On the red display layer 111R, a green display layer 111G which makes a display by switching between a green selective reflection state and a transparent state is provided, and on the layer 111G, a blue display layer 111B which makes a display by switching between a blue selective reflection state and a transparent state is provided.

Each of the display layers 111R, 111G and 111B has a resin columnar structure 115 and liquid crystal 116 between transparent substrates 112 which have transparent electrodes 113 and 114, respectively, thereon. On the transparent electrodes 113 and 114, an alignment controlling layer or an insulating layer may be provided.

The transparent electrodes 113 and 114 of each of the display layers 111B, 111G and 111R are connected to the LCD driver 26, and specified pulse voltages are applied between the electrodes 113 and 114. In each display layer, in response to the voltage applied, the liquid crystal 116 switches between a transparent state wherein the liquid crystal 116 transmits visible light and a selective reflection state wherein the liquid crystal 116 selectively reflects visible light of a specified wavelength, thereby switching a display.

The transparent electrodes 113 and 114 of each display layer are in the form of strips arranged in parallel at uniform intervals. The electrode strips 113 face the electrode strips 114, and the extending direction of the electrode strips 113 and the extending direction of the electrode strips 114 are perpendicular to each other. Electric power is applied between the upper electrode strips and the lower electrode strips. Thereby, a voltage is applied to the liquid crystal 116 in a matrix, so that the liquid crystal makes a display. This is referred to as a matrix drive. By performing this matrix drive toward the display layers sequentially or simultaneously, the liquid crystal display 100 displays a full-color image.

A liquid crystal display which has cholesteric liquid crystal or chiral nematic liquid crystal between two substrates makes a display by switching the liquid crystal between a planar state and a focal-conic state. In the planar state, the liquid crystal selectively reflects light of a wavelength $\lambda = P\ n$ (P: helical pitch of the cholesteric liquid crystal, n: average refractive index of the liquid crystal). In the focal-conic state, if the wavelength of light selectively reflected by the cholesteric liquid crystal is in the infrared spectrum, the liquid crystal scatters light, and if the wavelength of light selectively reflected is shorter than the infrared spectrum, the liquid crystal transmits visible light. Therefore, by setting the wavelength of light selectively reflected by the liquid crystal within the visible spectrum and providing a light absorbing layer on the side of the display opposite the observing side indicated by arrow "A", the liquid crystal, in the planar state, makes a display of a color corresponding to the wavelength of light selectively reflected and in the focal-conic state, makes a black display. Also, by setting the wavelength of light selectively reflected by the liquid crystal within the infrared spectrum and providing a light absorbing layer on the side of the display opposite the observing side, the liquid crystal, in the planar state, reflects infrared light and transmits visible light, thereby making a black display, and in the focal-conic state, scatters light, thereby making a white display.

If the threshold voltage to untwist liquid crystal which exhibits a cholesteric phase (first threshold voltage) is Vth1, by applying the voltage Vth1 to the liquid crystal for a sufficient time and thereafter dropping the voltage to less than a second threshold voltage Vth2 which is lower than the first threshold voltage Vth1, the liquid crystal comes to the planar state. By applying a voltage which is higher than Vth2 and lower than Vthl for a sufficient time, the liquid crystal comes to the focal-conic state. Each of the states is maintained even after stoppage of application of the voltage. It has been found that such liquid crystal also comes to a state where these two states are mixed. Accordingly, the liquid crystal can display intermediate tones, that is, can make a display with different tones.

Thus, liquid crystal which exhibits a cholesteric phase has a memory effect, which means that the liquid crystal can maintain its display state after stoppage of application of a voltage. Therefore, by driving a plurality of pixels of the display by a simple matrix driving method, a display of a desired image or letters becomes possible.

Full-Color Display

The liquid crystal display 100 which has color display layers 111R, 111G and 111B makes a red display by setting the liquid crystal 116 of the blue display layer 111B and the green display layer 111G to the focal-conic (transparent) state and setting the liquid crystal 116 of the red display layer to the planar (selective reflection) state. The liquid crystal display 100 makes a yellow display by setting the liquid crystal 116 of the blue display layer 111B to the focal-conic (transparent) state and setting the liquid crystal 116 of the green display layer 111G and the red display layer 111R to the planar (selective reflection) state. By setting the liquid crystal 116 of the respective color display layers to the transparent state or to the selective reflection state appropriately, displays of red, green, blue, white, cyan, magenta, yellow and black are possible. Also, by setting the liquid crystal 116 of the respective color display layers to the intermediate state, displays of intermediate colors are possible. Thus, the liquid crystal display 100 can be used as a full-color display.

Driving Circuit and Driving Method of Liquid Crystal Display

Figure 5:
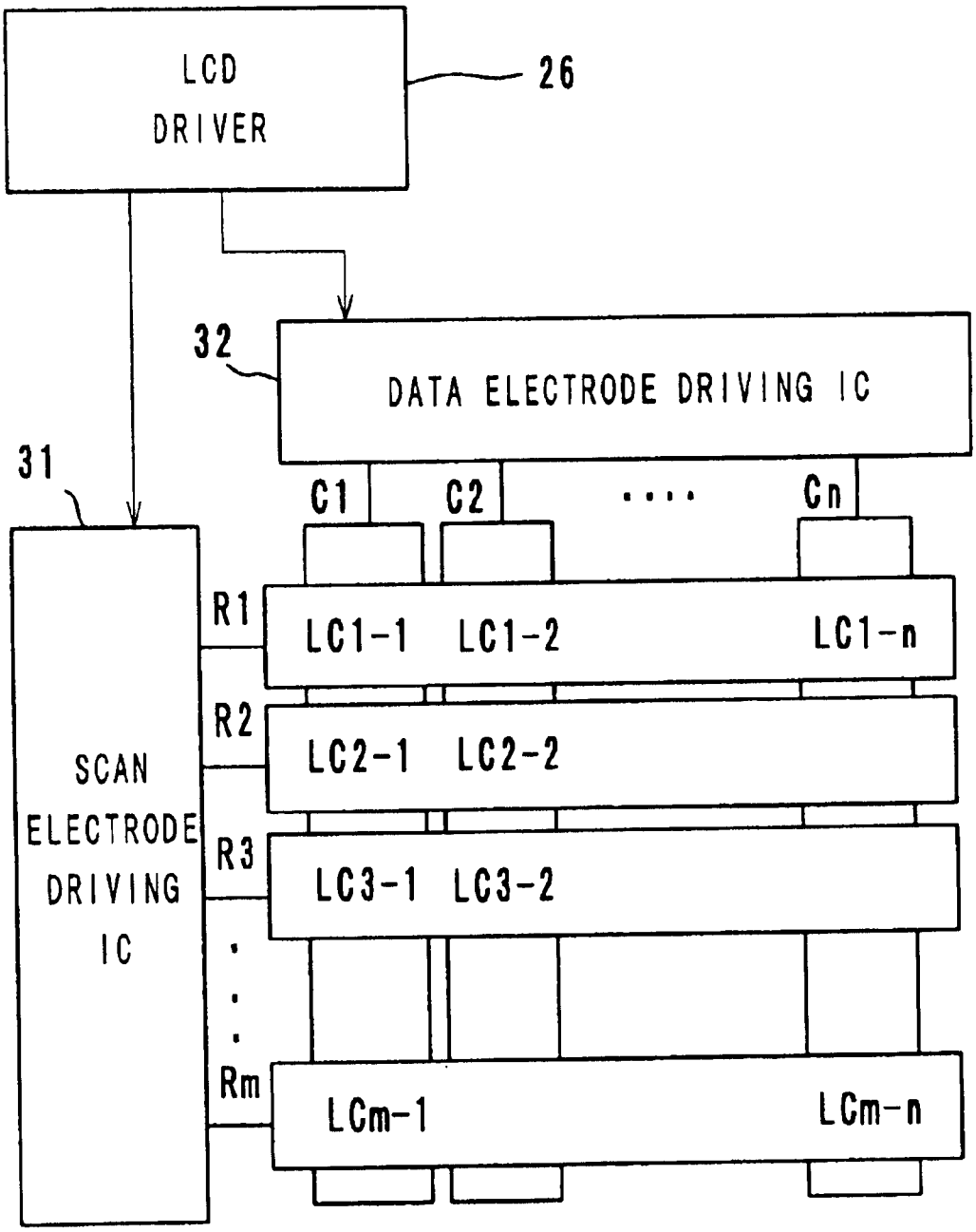
FIG. 5 is a block diagram which shows a driving circuit of the liquid crystal display.

In each of the display layers of the liquid crystal display 100, the pixels are structured in a simple matrix. Therefore, as FIG. 5 shows, the pixels can be expressed by a matrix of m×n, in which m is the number of scan electrodes (R1, R2 . . . Rm), and n is the number of data electrodes (C1, C2 . . . Cn). The pixel which is at the intersection of a scan electrode Ra and a data electrode Cb (a, b: natural numbers, $a \leqq m$, $b \leqq n$) is expressed by LCa-b. The scan electrodes and the data electrodes are connected to output terminals of a scan electrode driving IC 31 and to output terminals of a data electrode driving IC 32, respectively, and a scan voltage and data voltages are applied to the respective electrodes from the driving ICs 31 and 32 in accordance with the image data transmitted from the LCD driver 26.

The driving circuit for the liquid crystal display 100 is not limited W to such a matrix-structured driver. It is possible to carry out serial transmission of image data from the data electrode driving IC 32 via a line latch memory for each line of the scan electrode driving IC 31. In this case, the scan electrode driving IC 31 does not have to cope with lines, and an IC for serial usage is sufficient. Thus, the cost for the driver can be reduced.

Figure 6:
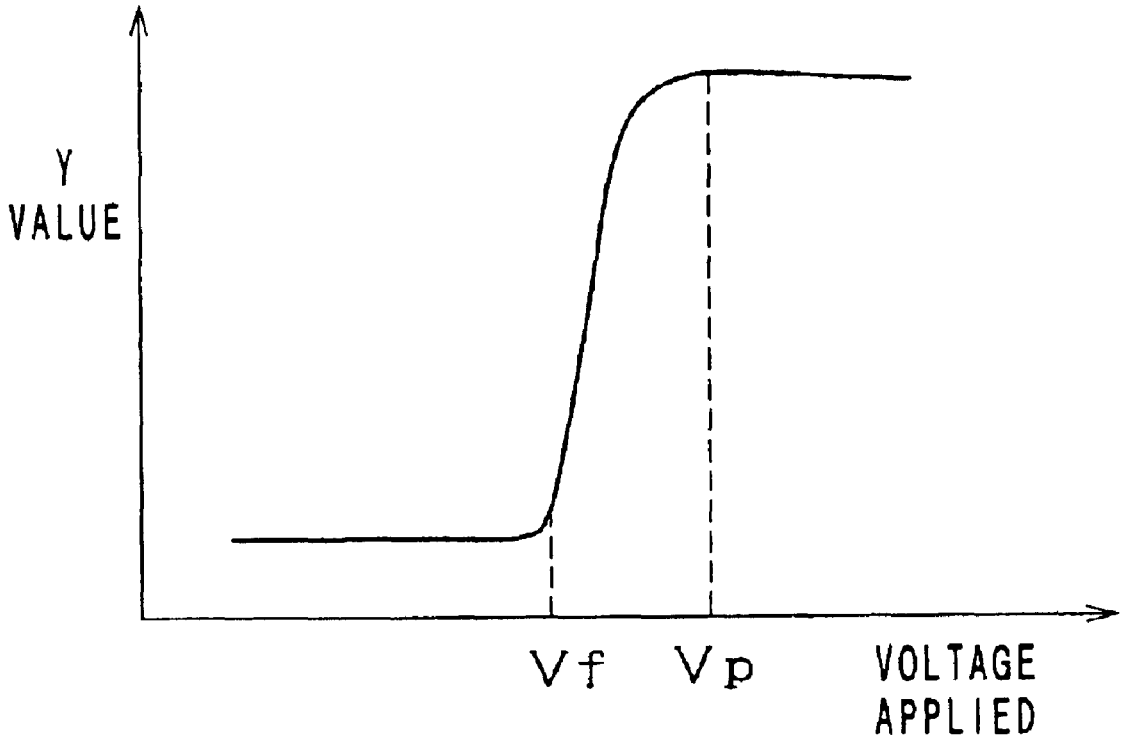
FIG. 6 is a graph which shows the relationship between the voltage of a selective signal in the driving circuit and the Y value.

In the liquid crystal display 100, the display state of the liquid crystal is a function of the voltage applied and the pulse width. By resetting the whole liquid crystal to the focal-conic state wherein the liquid crystal shows the lowest Y value (luminous reflectance) and thereafter, applying a pulse voltage with a constant pulse width to the liquid crystal, the display state of the liquid crystal changes as FIG. 6 shows. In the graph of FIG. 6, the y-axis indicates the Y value, and the x-axis indicates the voltage applied. When a pulse voltage Vp is applied, the liquid crystal comes to the planar state wherein the liquid crystal shows the highest Y value, and when a pulse voltage Vf is applied, the liquid crystal comes to the focal-conic state wherein the liquid crystal shows the lowest Y value. Also, when an intermediate pulse voltage between Vp and Vf is applied, the liquid crystal comes to an intermediate state between the planar state and the focal-conic state wherein the liquid crystal shows an intermediate Y value, and thus, a display of an intermediate color is possible.

Ordinary Display Mode

Figure 7:
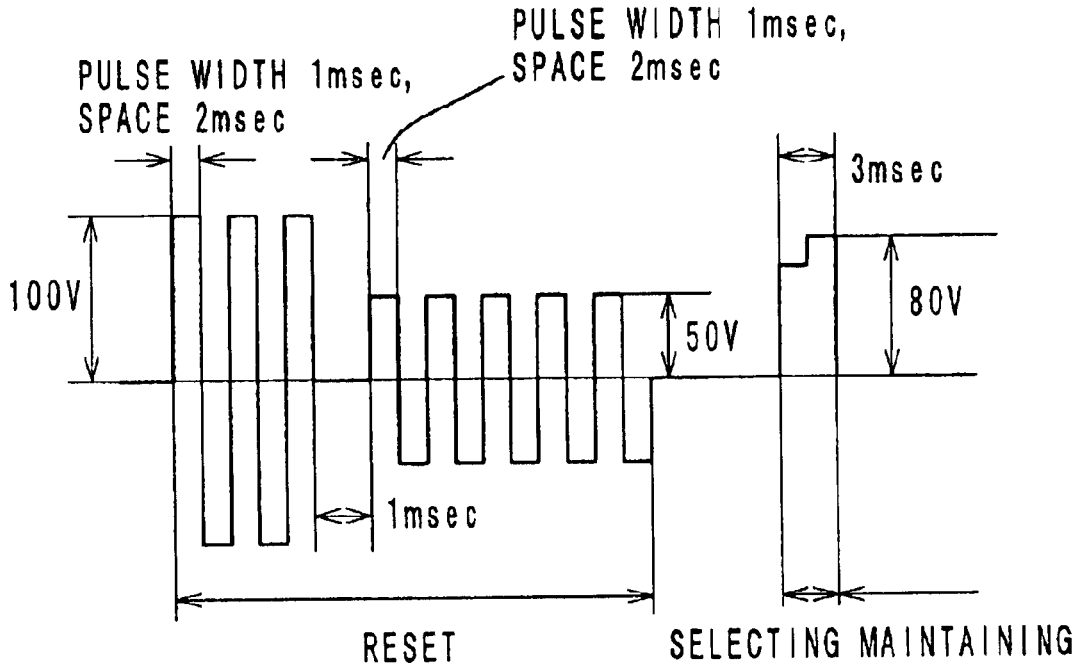
FIG. 7 is a chart which shows an exemplary waveform of a voltage applied for operation in an ordinary display mode.

FIG. 7 shows the waveform of a pulse voltage to drive the liquid crystal display 100 to make a multi-tone display in the ordinary display mode. Here, in a reset duration, the liquid crystal is reset to the focal-conic state, and in a selecting duration, a pulse voltage which changes between two stages is applied for three milliseconds to reproduce a multi-tone image. In a maintaining duration, a voltage of 0V is applied. Various driving methods as well as the method in which the voltage shown by FIG. 7 is applied can be adopted in the ordinary display mode.

Rapid Display Mode

Figure 8:
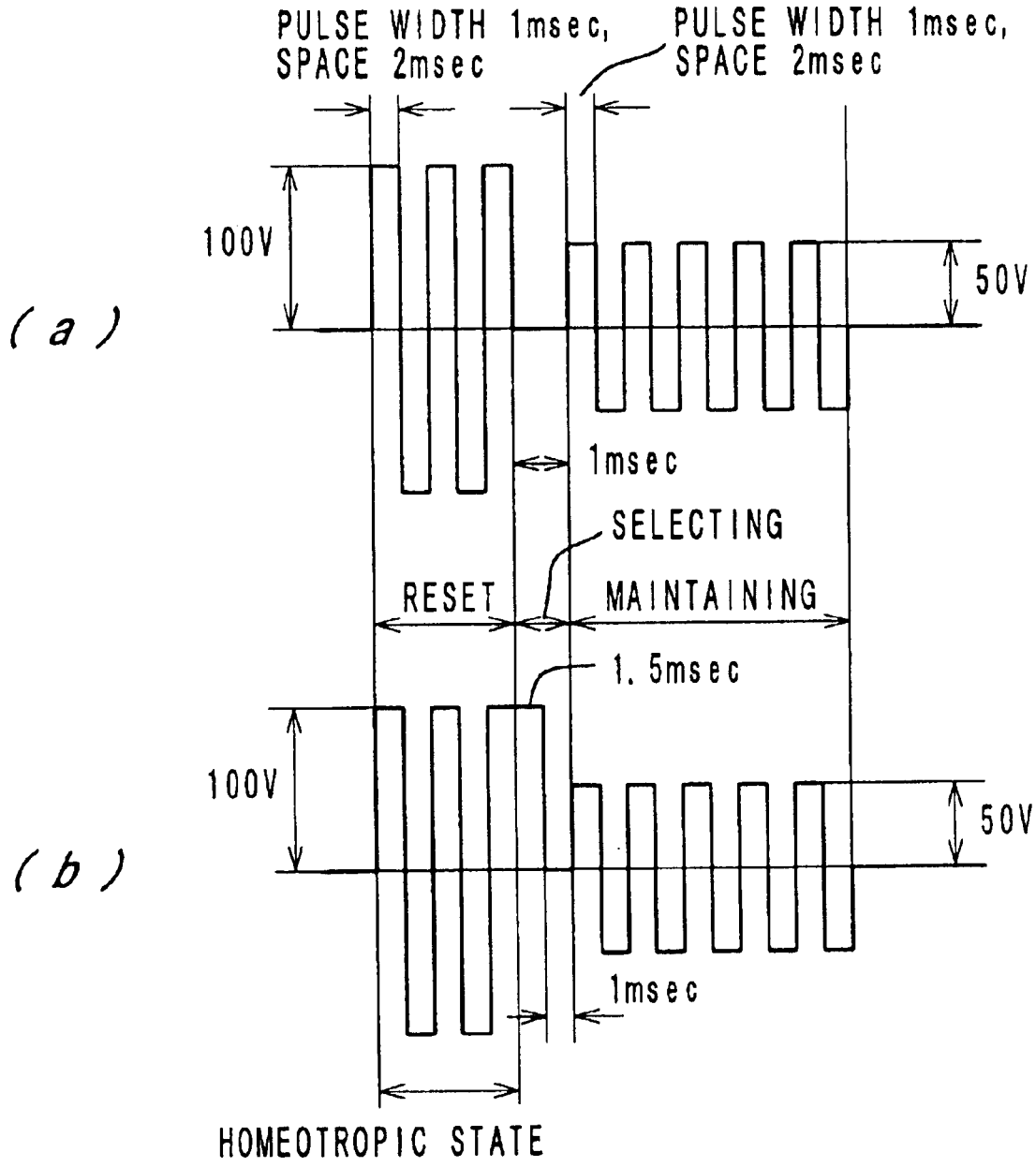
FIG. 8 is a chart which shows exemplary waveforms of voltages applied for operation in a rapid display mode.

FIG. 8 shows the waveforms (a) and (b) of pulse voltages to drive the liquid crystal display 100 in the rapid display mode. In the case of waveform (a), first, a pulse voltage of 100V is applied to the liquid crystal to cause the liquid crystal to come to a homeotropic state, and in a selecting duration, a voltage of 0V is applied. Then, in a maintaining duration, a pulse voltage of 50V is applied. In this case, the liquid crystal comes to the focal-conic state and maintains the state, that is, scatters light incident thereto (off state). In the case of waveform (b), the liquid crystal is reset to the homeotropic state, and subsequently, a pulse voltage of 100V is applied for 1.5 msec. Then, in the maintaining duration, a pulse voltage of 50V is applied. In this case, the liquid crystal changes to the planar state and maintains the state, that is, transmits light incident thereto (on state). By selecting the waveform (a) or (b) in accordance with image data, a two-value (on and off) image can be displayed.

The rapid display mode is to display information on the screens 2 and 3 as if paging, i.e., changing displayed pages of a book. In the rapid display mode, the driving voltages may be of other waveforms as well as those shown by FIG. 8, and various methods can be adopted. For example, reduced images may be displayed by omitting image data; a plurality of scanning lines are driven simultaneously for speedy writing; or only the first several lines of each page may be displayed.

Control Procedure

Figure 9:
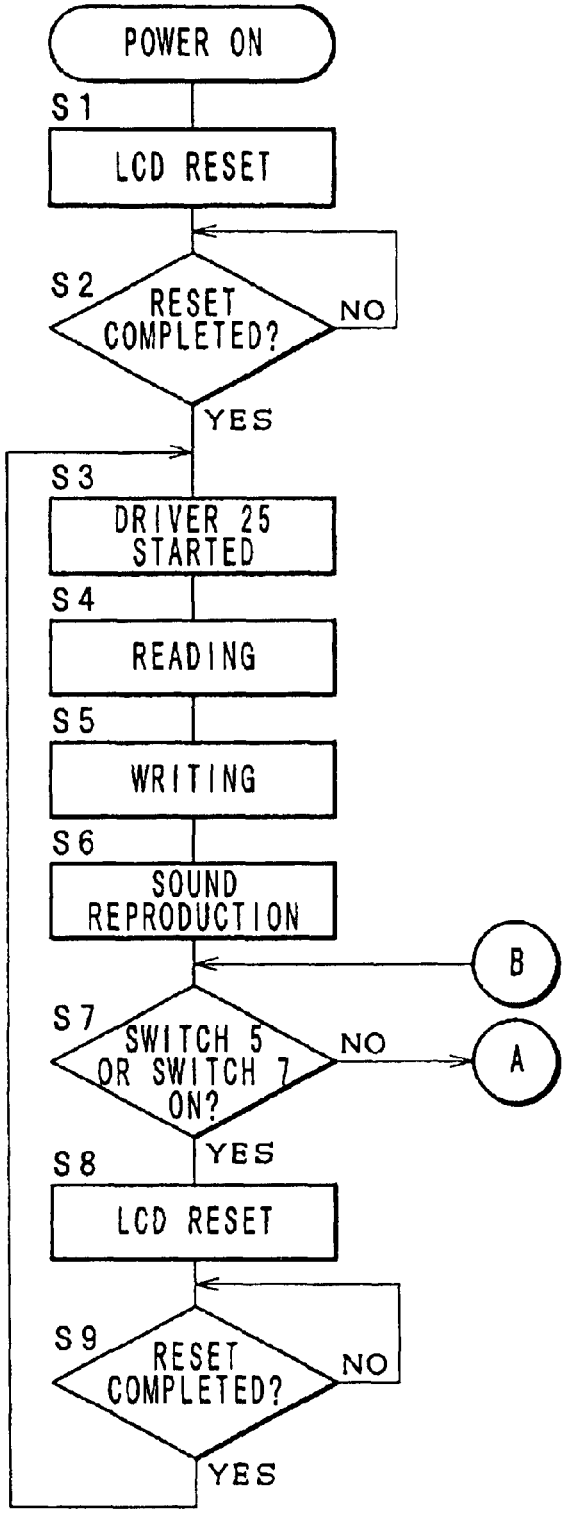
FIGS. 9 and 10 are flowcharts which show a control procedure performed by the control circuit.
Figure 10:
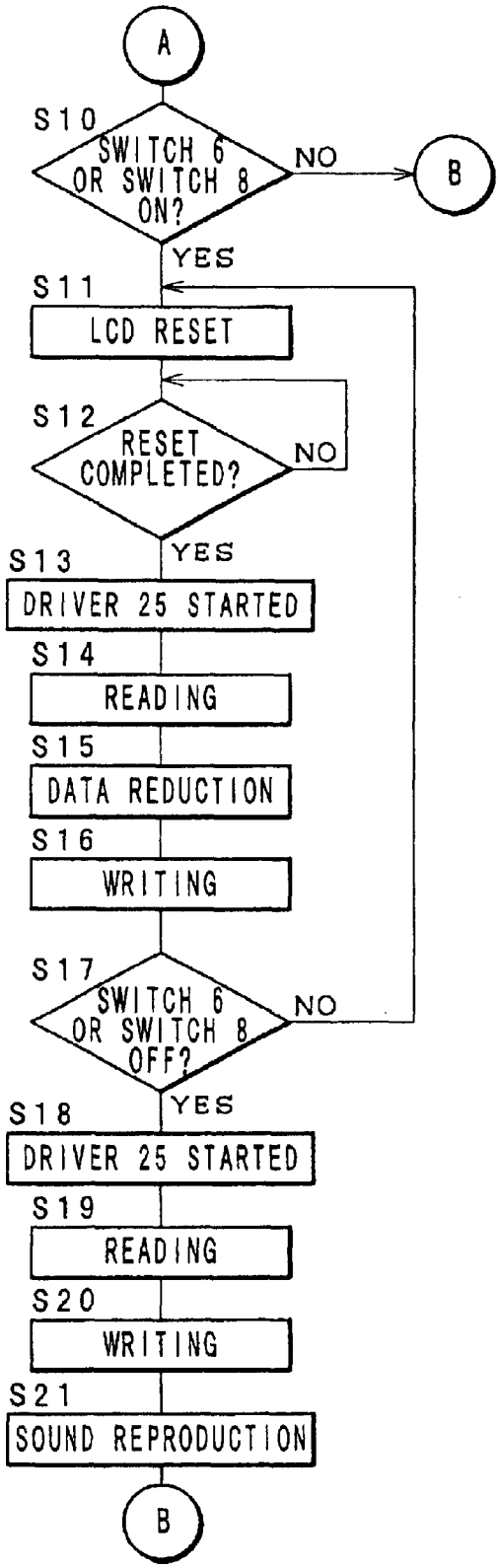

Referring to FIGS. 9 and 10, a control procedure performed by the CPU 21 to control the electronic book 1 is described.

When the power is turned on, first at step S1, the screens 2 and 3 are reset. Since the liquid crystal displays 100 have a memory effect, letters and images are displayed on the screens 2 and 3 even while the power is off. Therefore, the screens 2 and 3 are reset when the power is turned on. For the reset of the screens 2 and 3, pulse signals as shown in FIG. 7 are applied to the respective liquid crystal displays 100. It is not essential to reset the screens 2 and 3 when the power is turned on. The screens 2 and 3 may be reset when writing is commanded (as will be described later).

Next at step S2, completion of the reset is awaited. On completion, he storage medium driver 25 is started at step S3, and data are read out from the storage medium 15 at step S4. Letters and images are displayed in accordance with the read data on the screens 2 and 3 at step S5, and simultaneously, sound in accordance with the displayed information is reproduced at step S6.

Next, it is judged at step S7 whether or not the page forward switch 5 or the page backward switch 7 is on. If either the switch 5 or the switch 7 is on, the screens 2 and 3 are reset at step S8, and completion of the reset is awaited at step S9. On completion, the program goes back to step S3.

If neither the switch 5 nor the switch 7 is on ("NO" at step S7), it is judged at step S10 whether or not the fast forward switch 6 or the fast backward switch 8 is on. If neither the switch 6 nor the switch 8 is on, the program goes back to step S7. If either the switch 6 or the switch 8 is on, that is, when the rapid display mode is selected, the screens 2 and 3 are reset at step S11, and completion of the reset is awaited at step S12. On completion, the storage medium driver 25 is started at step S13, and data are read out from the storage medium 15 at step S14. The read data are processed into reduced image data at step S15. At this step, specifically, the image processing circuit 22 omits part of the data to reduce the volume of data for rapid display. Then, at step S16, letters and images are displayed on the screens 2 and 3.

Next at step S17, it is judged whether or not the fast forward switch 6 or the fast backward switch 8 is off. Unless the switch 6 or 8 is turned off, the program goes back to step S11. Accordingly, while the switch 6 or 8 is on, pages are serially displayed on the screens 2 and 3 in the rapid display mode. When the switch 6 or 8 is turned off, which means that the rapid display mode is cancelled, the ordinary display mode is executed. Specifically, the storage medium driver 25 is started at step S18, data are read out from the storage medium 15 at step S19, and letters and images are displayed on the screens 2 and 3 at step S20. Simultaneously, sound in accordance with the displayed information is reproduced at step S21. Then, the programs goes back to step S7.

In this control procedure, the driver 25 is started after completion of reset of the Screens 2 and 3 (see at step S2, S9 and S12). Thereby, a driving of the storage medium is inhibited during the reset operation of the screens 2 and 3, and the voltage supplied from the power source circuit 28 is prevented from dropping. Also, it never happens that reset of the screens 2 and 3 and reproduction of sound are simultaneously performed, and the voltage is prevented from dropping.

Further, reproduction of sound is never performed while the rapid display mode is executed (see S11 through S16), and reproduction of sound is performed after cancellation of the rapid display mode (see step S21). Thus, since reproduction of sound, which is a heavy load on the power source, is inhibited during execution of the rapid display mode, the rapid display mode is never slow. Needless to say, a voltage drop is avoided.

Other Embodiments

The appearance, the structure and the control circuit of the information display device (electronic book) may be of any type. Various structures and various driving methods can be adopted for the liquid crystal displays.

Although the present invention has been described in connection with the preferred embodiments above, it is to be noted that various changes and modifications are possible to those who are skilled in the art. Such changes and modifications are to be understood as being within the scope of the present invention.

What is claimed is:

1. An information display device comprising:

a display which is driven by a voltage applied thereto and which has a memory effect which is capable of keeping displaying information thereon after stoppage of supplying of electric power;

a slot which enables a storage medium to be inserted in and ejected from the information display device, the storage medium being stored with image data to be displayed on the display;

a storage medium driving circuit for reading the image data from the storage medium set in the slot;

an internal memory for storing the image data read from the storage medium;

a display driving circuit for driving the display by applying a voltage in accordance with the image data stored in the internal memory;

a power source section for supplying electric power to the display driving circuit and the storage medium driving circuit; and a control section which inhibits the display driving circuit and the storage medium driving circuit, respectively, from performing a display updating operation and from performing an image data reading operation simultaneously, the display updating operation being performed by application of a driving pulse voltage to the display including a reset pulse voltage for resetting a previously displayed image and by application of a driving pulse voltage to the display in accordance with an image data to be displayed.

2. An information display device according to claim 1, wherein the control section inhibits the storage medium driving circuit from performing an image data reading operation until the display driving circuit completes a display updating operation.

3. An information display device according to claim 1, wherein the display comprises liquid crystal which exhibits a cholesteric liquid crystal phase and makes a display by switching the liquid crystal between a planar state and a focal-conic state.

4. An information display device according to claim 1, wherein the power source section includes a booster circuit.

5. An information display device according to claim 1, wherein the power source section supplies electric power from a battery.

6. An information display device according to claim 3, wherein the liquid crystal is capable of making a color display.

7. An information display device according to claim 1, wherein the display comprises a plurality of screens.

8. An information display device according to claim 1, further comprising an open/close member for setting the display to an open state wherein the display is exposed and to a closed state wherein the display is covered.

9. An information display device according to claim 1, wherein the display is capable of displaying intermediate tones.

10. An information display device comprising:

a display which is driven by a voltage applied thereto and which has a memory effect which is capable of keeping displaying information thereon after stoppage of supplying of electric power;

a display driving circuit for driving the display by applying a voltage to the display, the display driving circuit being capable of operating in a first mode wherein the display is updated intermittently and in a second mode wherein the display is updated continuously, at least one peripheral device;

a power source section for supplying electric power to the display driving circuit and the peripheral device; and a control section which, in the second mode, inhibits the display driving circuit and the peripheral device, respectively, from performing a display updating operation and from operating the peripheral device simultaneously, the display updating operation being performed by application of a driving pulse voltage to the display including a reset pulse voltage for resetting previously displayed image and by application of a driving pulse voltage to the display in accordance with an image data to be displayed.

11. An information display device according to claim 10, wherein the at least one peripheral device is a sound reproducing device for reproducing sound in accordance with information displayed on the display.

12. An information display device according to claim 10, wherein in the second mode, the display is driven by a driving pulse voltage comprising a reset step of resetting a display layer of the display, a selection step of selecting a desired display state and an evolution step of evolving the display layer to evolve to the selected state.

13. An information display device according to claim 10, wherein the control section inhibits the peripheral device from operating while the display driving circuit repeats the display updating operation performed by applying a driving pulse voltage including a reset pulse voltage for resetting previously displayed information.

14. An information display device according to claim 10, wherein the display comprises liquid crystal which exhibits a cholesteric phase and makes a display by switching the liquid crystal between a planar state and a focal-conic state.

15. An information display device according to claim 10, wherein concurrently driving the at least one peripheral device and the display driving circuit causes an excessive drop in a voltage of the electric power.

16. An information display device according to claim 10, further comprising an operation key unit for permitting an operator to input a command to perform a display updating operation in the first mode or display updating operation in the second mode.

17. An information display device comprising:

a display which is driven by a voltage applied thereto and which has a memory effect which is capable of keeping displaying information thereon after stoppage of supplying of electric power;

a storage medium stored with image data to be displayed on the display;

a storage medium driving circuit for reading the image data from the storage medium, the storage medium driving circuit comprising a motor for driving the storage medium and a head for reading image data from the storage medium;

a display driving circuit for driving the display by applying a voltage in accordance with the image data read from the storage medium;

a power source section for supplying electric power to the display driving circuit and the storage medium driving circuit; and a control section which inhibits the display driving circuit and the storage medium driving circuit, respectively, from currently performing a display updating operation and an image data reading operation, the display updating operation being performed by application of a driving pulse voltage to the display including a reset pulse voltage for resetting a previously displayed image and by application of a driving pulse voltage to the display in accordance with an image data to be displayed.

18. An information display device according to claim 17, wherein the display comprises liquid crystal which exhibits a cholesteric phase and makes a display by switching the liquid crystal between a planar state and a focal-conic state.

19. An information display device comprising:

a display which is driven by a voltage applied thereto and which has a memory effect which is capable of keeping displaying information thereon after stoppage of supplying of electric power;

a display driving circuit for driving the display by applying a voltage to the display;

at least one peripheral device, simultaneous driving of the at least one peripheral device and the display driving circuit causing an unstable operation;

a power source section for supplying electric power to the display driving circuit and the at least one peripheral device, the power source section including a booster circuit for raising the voltage supplied from a battery; and a control section which inhibits the display driving circuit and the peripheral device, respectively, from performing a display updating operation and from operating the peripheral device, simultaneously, the display updating operation being performed by application of a driving pulse voltage to the display including a reset pulse voltage for resetting a previously displayed image and by application of a driving pulse voltage to the display in accordance with an image data to be displayed.

20. An information display device according to claim 19, wherein the display comprises liquid crystal which exhibits a cholesteric phase and makes a display by switching the liquid crystal between a planar state and a focal-conic state.

* * * * *